United States Patent [19]

Forquer

[11] 4,422,493

[45] Dec. 27, 1983

[54] SUPPORT MEMBERS AND GEAR DRIVE FOR SHUTTER AND AWNING DEVICES

[75] Inventor: William F. Forquer, Venice, Fla.

[73] Assignee: Security Shutter Corp., Venice, Fla.

[21] Appl. No.: 331,257

[22] Filed: Dec. 16, 1981

[51] Int. Cl.[3] ..... E06B 9/08

[52] U.S. Cl. ..... 160/133; 160/309

[58] Field of Search ..... 160/133, 176 R, 177, 160/178, 189, 193, 309, 312, 319; 74/DIG. 10, 425, 424.5, 424.7, 427

[56] References Cited

U.S. PATENT DOCUMENTS

| | | | |
|---|---|---|---|
| 1,306,127 | 6/1919 | Sharps et al. | 160/319 |
| 1,683,903 | 9/1928 | Kirschberg | 160/309 |
| 1,744,686 | 1/1930 | Pease et al. | 160/309 |
| 3,081,644 | 3/1963 | Hudgens et al. | 74/424.7 |
| 4,200,135 | 4/1980 | Henneguin | 160/176 R |
| 4,294,302 | 10/1981 | Ricke, Sr. | 160/133 |

FOREIGN PATENT DOCUMENTS

| | | | |
|---|---|---|---|
| 27218 | of 1903 | United Kingdom | 160/319 |

*Primary Examiner*—Peter M. Caun

*Attorney, Agent, or Firm*—Hauke and Patalidis

[57] ABSTRACT

A support member for the end of a rotatable shaft for winding and unwinding a curtain of articulated slats forming a roll-type shutter or awning. The support member is made of a pair of interlocked, L-shaped plates forming a box-like structure open at both ends. A bushing, through which is passed the end of the rotatable shaft, is journalled through one of the L-shaped plates and is held in position by a U-shaped saddle member. The support member is converted to a gear drive by replacing the bushing with a worm wheel and mounting in the U-shaped saddle member a worm gear meshing with the worm wheel. The worm gear is mounted on, or made integral with, a drive shaft. The U-shaped saddle member is arranged to be mounted in any one of a plurality of positions within the box-like enclosure so as to provide several possible orientations for the drive shaft. Preferably, the worm wheel and the worm gear are each made of a single piece of metallic material, including their respective shafts, and are coated with a plastic material such as a fluorocarbon and, preferably, polytetrafluoroethylene.

10 Claims, 12 Drawing Figures

FIG. 2
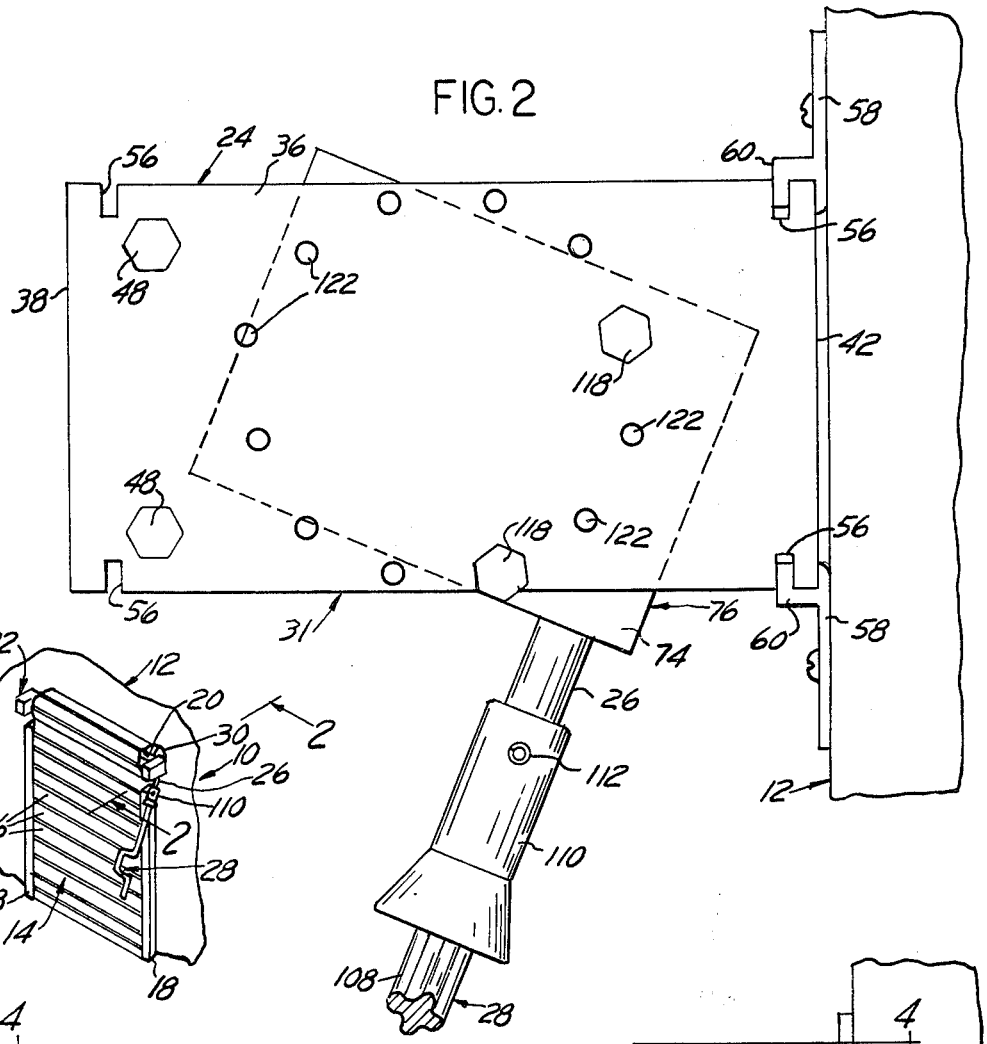
FIG. 1
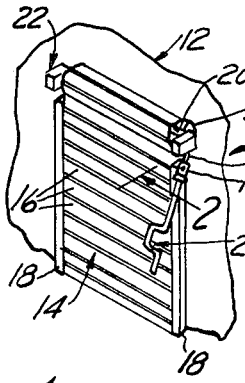
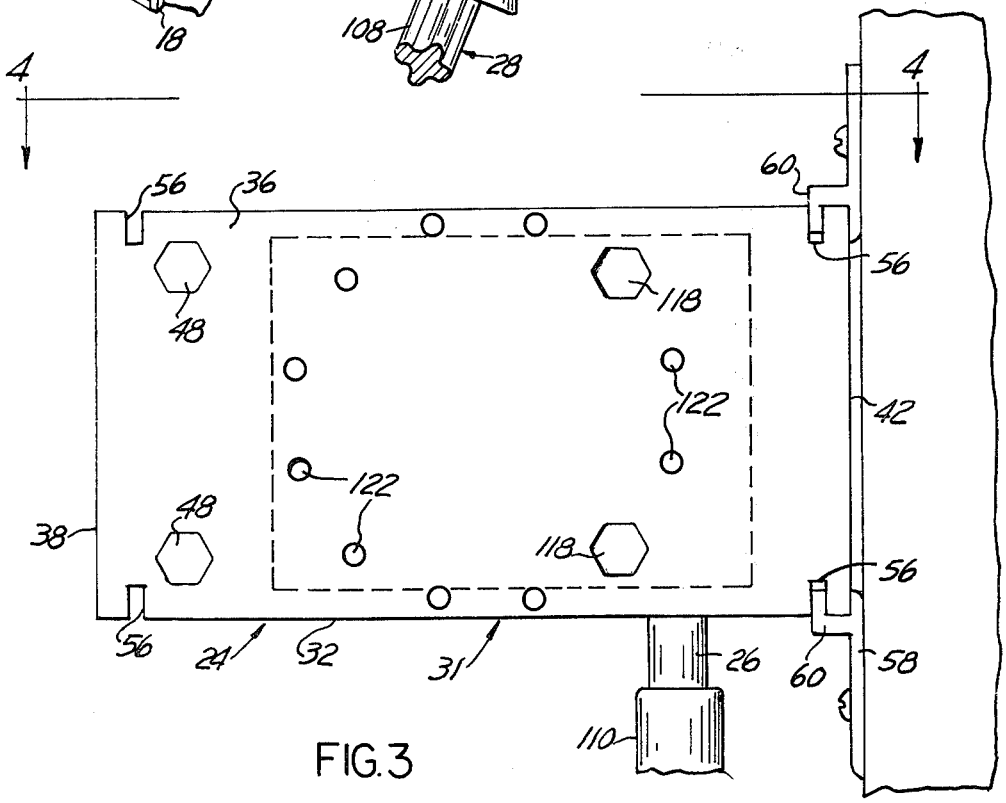
FIG. 3

SUPPORT MEMBERS AND GEAR DRIVE FOR SHUTTER AND AWNING DEVICES

BACKGROUND OF THE INVENTION

The present invention relates to support members and a gear drive for protective roll-type shutter or awning, and the like.

Security-type shutters and awnings comprising a plurality of slats made of extruded aluminum, or other material, hingedly interlocked at each edge, and which can be rolled away by winding around a drum or about a rotatable shaft, are generally provided with a gear drive for the drum or rotatable shaft, which also functions as a support member and journal means for an end of the rotatable shaft. Such an arrangement is disclosed, for example, in U.S. Pat. No. 4,294,302, assigned to the same assignee as the present application.

The gear drive for the rotatable shaft of the shutter or awning device has a driving shaft which is capable of being directly driven in rotation by a handcrank, or by a second shaft in turn hand or power driven through a second gear drive. The gear drive is enclosed in a housing, and the driven shaft and driving shaft are generally coupled by means of a pair of bevel gears having their axes of rotation disposed in a plane at right angle to each other. The journal bearings supporting respectively the driving shaft and the driven shaft are supported through the walls of the housing, at fixed location, such that the relative orientation of the driven and driving shaft is dictated by the design of the gear box, and there is no adjustment provided for the relative angular orientation of the shafts. Furthermore, the bevel gears generally provide a one-to-one gear ratio, which requires considerable manual effort for cranking heavy shutter assemblies, and the gear drive is reversible, which requires that some locking means be provided, even though some attempts may be made at counterbalancing the weight of the closed shutter.

SUMMARY OF THE PRESENT INVENTION

The present invention remedies the inconveniences of the prior art by providing a gear drive for raising or lowering roll-type shutters, and awnings, of the worm wheel and gear type, and which permits adjustable orientation of the driving shaft relative to the drive shaft for more effective installation of the shutter assembly.

The present invention also provides for an assembly that requires no lubrication which is subject to very little wear and which is protected against corrosion even when installed proximate, for example, a body of sea water.

These and other objects and advantages of the present invention will become apparent to those skilled in the art when the following description of the best mode contemplated for practicing the invention is read in conjunction with the accompanying drawing, wherein like numerals refer to like or equivalent parts, and in which:

BRIEF DESCRIPTION OF THE DRAWING

FIG. 1 is a schematic perspective view of a shutter assembly shown in its lower position over a window or door;

FIG. 2 is a side elevation view, as seen from line 2—2 of FIG. 1, of the gear drive mechanism therefor;

FIG. 3 is a view similar to FIG. 2 but showing the driving or input shaft thereof oriented at a different angle;

DETAILED DESCRIPTION OF THE PREFERRED EMBODIMENTS

Figure 4:
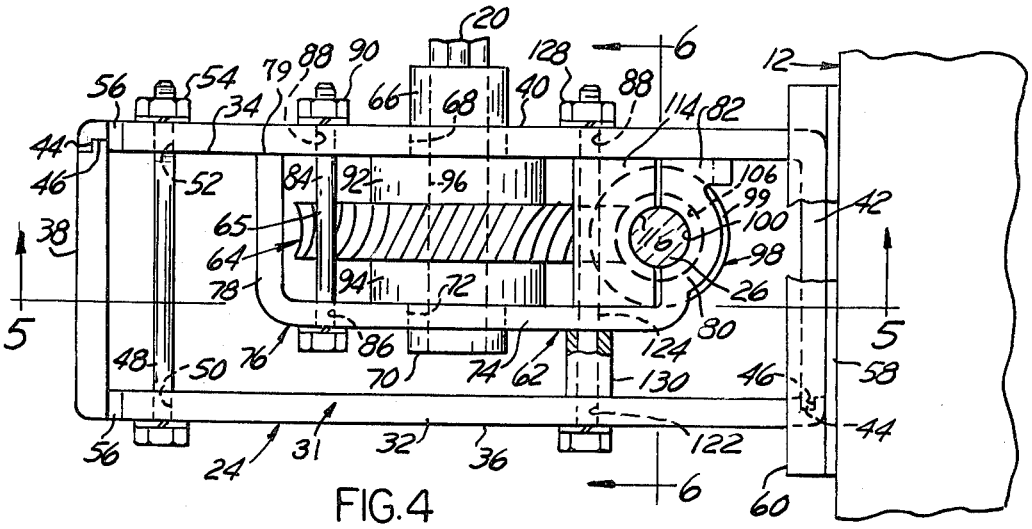
FIG. 4 is a top plan view thereof as seen from line 4—4 of FIG. 3.

Referring to FIG. 1 of the drawing, a roll-up shutter assembly 10 is shown in its lowered position, covering a window or door, not shown, in a wall 12. The shutter assembly 10 comprises a curtain 14 made of a plurality of individual elongated slat members 16 attached to each other along their adjoining edges such as to be articulated relative to each other. The curtain 14 of interlocked hinged slats 16 is vertically slidable between parallel lateral guide rails 18 and is capable of being raised from the shown lowered position by being wound about the periphery of a rotatable shaft 20 supported at one end by, for example, a support bracket or member 22 and at its other end by a support and gear drive member 24. A gear drive mechanism disposed in the support and gear drive member 24 drives the rotatable shaft 20 in rotation from an input or driving shaft 26 by means of a hand crank 28, for example. In the assembly illustrated at FIG. 1, the rotatable shaft 20 supports a drum around which the shutter slats 16 are wound or unwound. Alternatively, and preferably as shown, spoke-like brackets 30 affixed to the rotatable shaft 20 and to the end slat of the slat curtain 14, as explained in detail in the aforesaid U.S. patent, permit the curtain 14 of slats 16 to wind and unwind about the rotatable shaft 20, spaced away therefrom, when the rotatable shaft 20 is rotated in one direction or the other.

As shown in detail at FIGS. 2–7, the support and gear drive member 24 in the form of an open-ended enclosure 31 is made of two relatively heavy gauge L-shaped metallic plates 32 and 34, such as steel or aluminum plates. The L-shaped plate 32 forms a relatively long sidewall 36 and a relatively short sidewall 38, and the L-shaped plate 34 forms, in a similar manner, a relatively long sidewall 40 and a relatively short sidewall 42, the short sidewalls 38 and 42 being disposed substantially at right angle to the longer sidewalls 36 and 40, respectively. The free end of the short sidewall 38 or 42 is provided with a step 44 having a projecting portion engaged in a groove 46 formed on the internal surface of the long sidewall 36 or 40, such as to mutually interlock at their edge a long sidewall 36 or 40 with a short sidewall 38 or 42, FIG. 4.

The L-shaped plates 32 and 34 are held together, such as to form the enclosure 31 in the shape of a generally rectangular box open at its top and bottom, by means of a pair of through-bolts 48 passed through appropriate aligned holes 50 and 52 in the long sidewalls 36 and 40, respectively, the end of each bolt 48 threading through a nut 54. Each corner of the long sidewall 36 or 40 has a notch 56, such that the enclosure 31 may be held attached to the wall 12 by means of a pair of brackets 58 each having a bifurcated end 60 engaging the top and bottom edge of one of the narrow sidewalls 38 and 42 of the enclosure 31, one bracket 58 being mounted below and the other above the enclosure 31.

Figure 5:
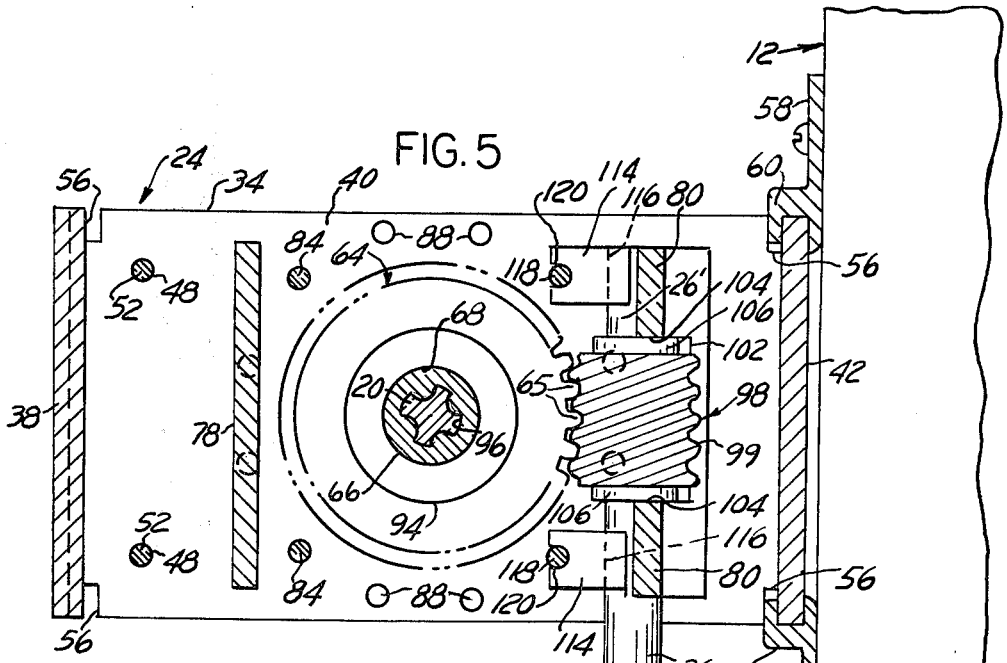
FIG. 5 is a longitudinal sectional view thereof as seen from line 5—5 of FIG. 4.
Figure 6:
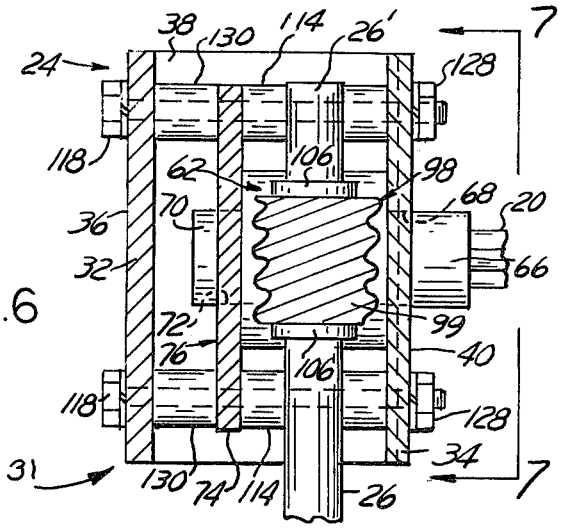
FIG. 6 is a cross-sectional view thereof as seen from line 6—6 of FIG. 4.

As best seen at FIGS. 4–6, a gear drive 62 is mounted in the enclosure 31. The gear drive 62 comprises a worm wheel 64 peripherally provided with teeth 65 and having a stub shaft 66 on one side journalled through an appropriate bore 68 disposed substantially at the center of the long sidewall 40 of the L-shaped plate 34. The bore 68 may be provided, if so desired, with appropriate bearing means. The worm wheel 64 has another stub shaft 70 projecting on its other side through an appropriate journalling bore 72 disposed through the sidewall 74 of a substantially U-shaped saddle member 76. The saddle member 76 has an end portion bent over at right angle, as shown at 78, having an edge 79 abutting against the internal surface of the enclosure sidewall 40, and a second end portion or leg 80, also bent over at right angle, having a relatively large area foot portion 82 also abutting against the interior surface of the sidewall 40. A pair of through-bolts 84, passed through aligned apertures 86 and 88, respectively through the sidewall 74 of the saddle 76 and the enclosure sidewall 40, cooperating with nuts 90, hold the saddle 76 clamped in position, as shown.

The stub shaft 66 of the worm wheel 64 has an enlarged portion 92 defining a spacer, and the stub shaft 70 of the worm wheel 64 has an enlarged diameter portion 94 also defining a spacer, such as to prevent lateral displacement of the worm wheel 64. A bore 96, FIG. 5, is axially formed through the stub shafts 66 and 70, spacers 92 and 94 and worm wheel 64 which, preferably, are all made as a single piece, or, alternatively, made of separate elements integrally joined together. The axial bore 96 is splined such as to accept the splined shaft 20, such that when the worm wheel 64 is driven in rotation, the shaft 20 is also driven in rotation.

A worm pinion 98 is tangentially disposed relative to the worm wheel 64. The teeth 65 of the worm wheel 64 mesh with the teeth or scroll 99 of the worm pinion 98 which is keyed on, or made integral with, the drive shaft 26. The leg portion 80 of the saddle 76 is provided with a substantially half-cylindrical recess 100, FIG. 4, in which journals the drive shaft 26 and the projecting portion 26' of the drive shaft. The leg portion 80 of the saddle 76 is provided with a cut-out section 102 providing clearance for the periphery of the worm gear 98 and forming thrust bearings, as shown at 104, for integral spacers 106 formed on each side of the worm gear 98 to prevent longitudinal displacement of the worm gear 98 when the drive shaft 26 is driven in rotation, for example, from the driving end 108 of a crank 28 introduced through a cap 110 keyed on the end of the drive shaft 26 by means, for example, of a spring cotter pin 112.

Preferably, a pair of plastic inserts 114 provided each with a substantially half-cylindrical recess 116 in engagement with the peripheral surface of respectively the drive shaft 26 and the drive shaft extension 26', are held a pair of through-bolts, 118 engaged through a slot 120 in each insert 114, passing through aligned holes 122, 124 and 88, respectively through the enclosure sidewall 36, the saddle sidewall 74 and the enclosure opposite sidewall 40, the through-bolts 118 being held fastened by nuts 128, FIGS. 4 and 6. The bolts 118 are passed each through a tubular spacer 130 disposed between the internal surface of the enclosure sidewall 36 and the exterior surface of the saddle sidewall 74, such that the through-bolts 118, in cooperation with the spacers 130, assist in clamping the saddle 76 against the interior surface of the enclosure sidewall 40.

The inserts 114, although not absolutely required, by way of their half-cylindrical recess 116 combined with the half-cylindrical recess 100 in the saddle leg 80, contribute to forming full journal bearings for the drive shaft 26 and the drive shaft extension 26'. The insert 114 may be made of slightly resilient elastomeric material, and may be installed in compression such as to form a drag brake for the drive shaft 26.

Figure 7:
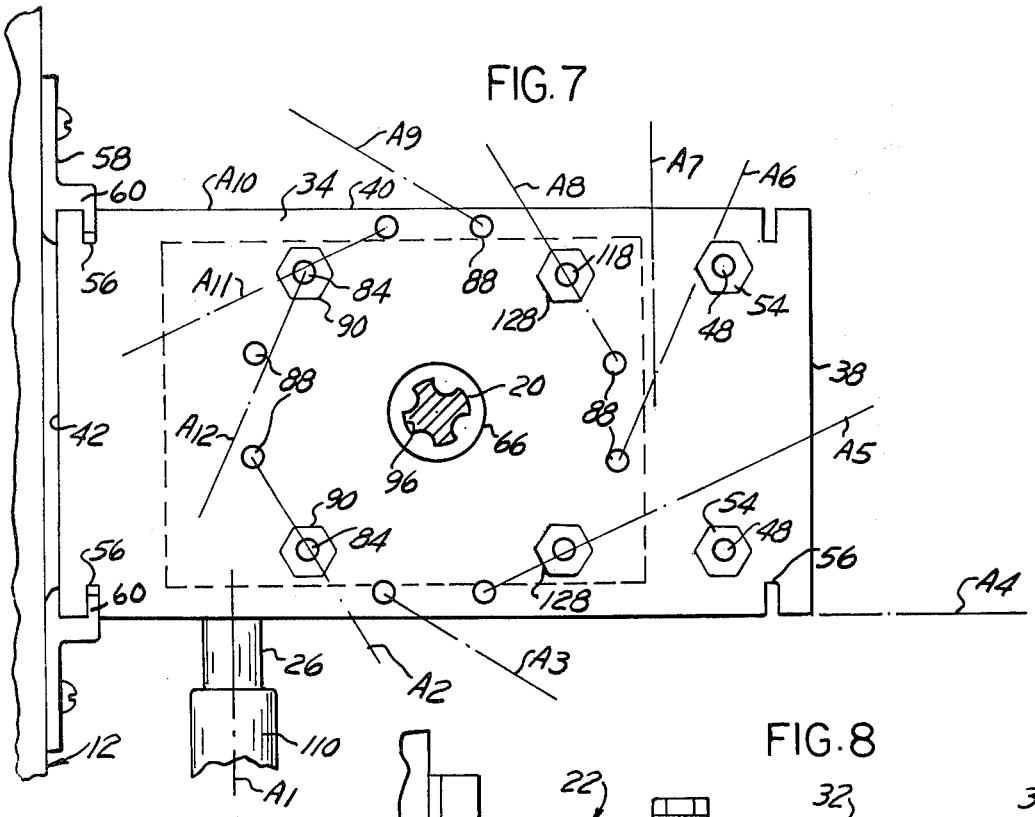
FIG. 7 is a side elevational view thereof from line 7—7 of FIG. 6.

As best shown at FIGS. 2, 3 and 7, the sidewall 36 of the enclosure 31 is provided with a plurality of holes 122 disposed in a circular row. The sidewall 34, FIG. 7, of the enclosure 31 is similarly provided with a plurality of holes 88, each hole 88 being aligned with a hole 122 in the enclosure opposite sidewall 36, each circular row of holes being concentric with the longitudinal axis of the output rotatable shaft 20. In this manner, by removing the nuts 128 and 90, by removing the bolts 118 and pulling back the bolts 84, the saddle 76 may be rotated around the axis of the output shaft 20, and by reinserting the bolts 118 into the appropriate aligned holes 122 and 88, and by reintroducing the end of bolts 84 in the appropriate holes 88, the saddle 76 may be reinstalled such that the drive shaft 26 is angularly disposed at any convenient inclination, as shown, for example at FIGS. 2 and 3, showing two different angular positions of the drive shaft 26. In the example of structure illustrated, the holes 122, and the corresponding holes 88, are disposed 30° apart, which provide twelve different finite positions for the input driving shaft 26. At FIG. 7, the diverse twelve possible positions for the axis of the drive shaft 26 are illustrated from $A_1$ to $A_{12}$. It will be readily appreciated that in order to place the drive shaft 26 in the position $A_4$ and $A_{10}$ a half circular notch must be provided respectively at the bottom edge of the narrow sidewall 38 and at the top edge of that narrow sidewall 42 of the enclosure 31. For the drive shaft 26 to occupy the angular position $A_5$ and $A_{11}$, a circular bore must be provided in, respectively, the sidewall 38 and the sidewall 42. When the drive shaft 26 occupies the position $A_{10}$ to $A_{12}$, directed toward the wall 12, raising and lowering the shutter curtain 14, FIG. 1, may be effected from the interior of a building, by providing an appropriate aperture through the wall 12 and coupling an appropriate shaft extension to the drive shaft 26.

It will be readily appreciated that the holes 122 and 88 may be less or more than illustrated, and that arcuate slots may be used, instead of circular apertures, to provide infinite position adjustments of the axis of the drive shaft 26, instead of the finite position adjustments hereinbefore described.

Figure 8:
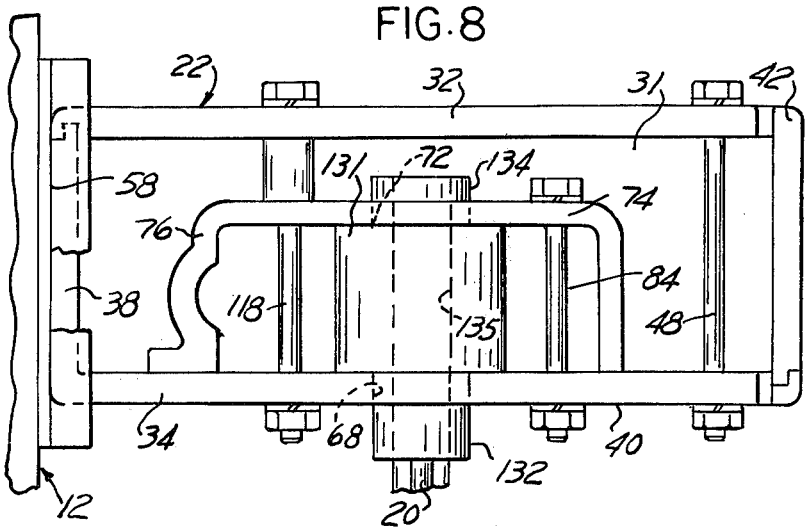
FIG. 8 is a top elevation view, substantially similar to FIG. 4, but showing the invention with gear drive elements omitted for providing a support member for the non-driven end of a shutter assembly rotatable winding shaft.
Figure 9:
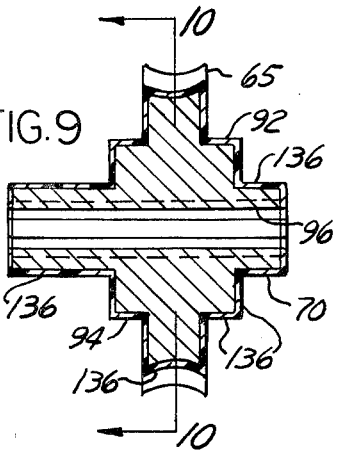
FIG. 9 is a longitudinal section through the worm wheel element of the gear drive of FIGS. 2–7.
Figure 10:
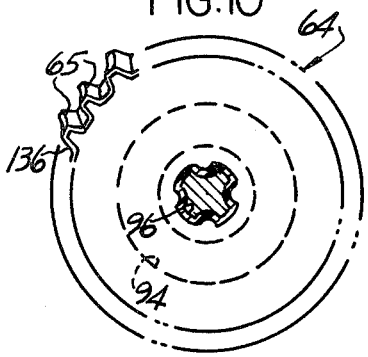
FIG. 10 is a cross-section along line 10—10 of FIG. 9.
Figure 11:
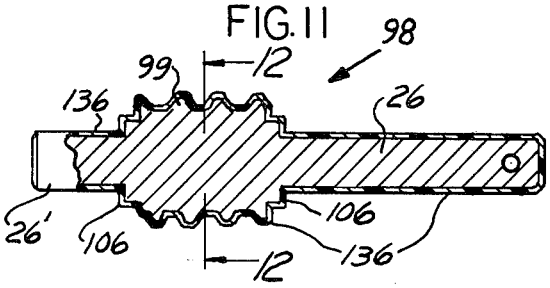
FIG. 11 is a longitudinal section through a worm gear.
Figure 12:
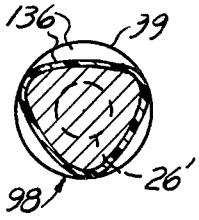
FIG. 12 is a cross-sectional view along line 12—12 of FIG. 11.

The support member 22, FIG. 1, may be made by assembling the parts forming the enclosure 31. As illustrated at FIG. 8, the L-shaped plates 32 and 34 are joined to form the enclosure 31, and the saddle member 76 is fastened within the enclosure 31, as previously described in detail. The gear drive assembly consisting of the worm wheel and worm gear is, of course, omitted and the worm wheel is replaced by a bushing member 131 having reduced diameter portions 132 and 134 journalling in bores 68 and 72 respectively through the enclosure sidewall 40 and the saddle sidewall 74. The bushing member 131 has an axial splined bore 135 accepting therethrough the end of the splined shaft 20 around which the shutter is wound. By using such a structure for the support member 22, the number of different parts being kept in inventory is relatively low.

FIGS. 9–12 illustrate another important aspect of the present invention. The worm wheel 64 and the worm gear 98 are each preferably made in a single piece of metal or alloy such as steel, stainless steel or preferably aluminum or aluminum alloy. They are cast or machined slightly undersized and coated on all their surfaces with a thin coating 136, of the order of, for example, 0.01 mm. to 0.10 mm. of a synthetic plastic resin, preferably a fluoroplastic or fluorocarbon, which provides a certain amount of lubricity to any surface in engagement with another surface, such as the journal and bearing surfaces and the surfaces of the teeth 65 of the worm wheel 64 and the teeth or scroll 99 of the worm gear 98. In addition, the surface coating 136 provides an effective seal of the metallic surfaces providing good protection against corrosion, even though the diverse parts are relatively exposed to the elements, are not lubricated, and may be exposed to a highly corrosive atmosphere as would be the case for shutter installations at the seashore, for example. A group of fluoroplastics or fluorocarbons which have been found to be particularly advantageous for forming the coating 136 consists of polyvinylidene fluoride, chlorotrifluoroethylene, and more particularly fluorinated ethylene-propylene, such as polytetrafluoroethylene. The coating 136 may be applied by spraying, painting, or dipping.

Having thus described the present invention by way of examples of structures well designed for accomplishing the objects thereof, modification whereof will be apparent to those skilled in the art, what is claimed as new is as follows:

1. In a protective shutter assembly for an opening in a wall or the like comprising an articulated curtain of a plurality of interlocked elongated rigid slats assembled hingedly relative to each other, a drive mechanism for raising and lowering said articulated curtain, said drive mechanism comprising a shaft having an axis of rotation disposed substantially parallel to the longitudinal axis of said slats, and support members for rotatably supporting said shaft at each end for winding said curtain about said shaft, the improvement comprising one of said support members being an open-ended enclosure having a pair of substantially parallel long sidewalls interconnected by a pair of substantially narrow sidewalls, support bracket means for supporting said enclosure from a wall with said relatively long sidewalls substantially perpendicular to the axis of said shaft, bearing means mounted on the end of said shaft and rotatably supported in a first aperture through one of said long sidewalls, a U-shaped saddle member having a second aperture providing a journal for a portion of said bearing means, a worm wheel mounted and coupled to said shaft within said U-shaped saddle member, a worm gear tangentially meshing with said worm wheel, said worm gear being mounted on and coupled to a drive shaft rotatably supported by said saddle member, wherein said saddle member has a partially cylindrical recess in supporting engagement with said drive shaft, and fastening means for attaching said U-shaped saddle to the inside surface of said long sidewall with said apertures substantially aligned.

2. The improvement of claim 1 wherein said enclosure has a pair of aligned notches at each corner thereof and said support bracket means comprises a pair of flat plate members having a bifurcated end forming a leg engaged in said notches on one edge of said enclosure, one of said support bracket means being disposed above and the other below said enclosure.

3. The improvement of claim 1 further comprising an insert member having a partially cylindrical recess disposed diametrically opposite said partially cylindrical recess in said saddle member.

4. The improvement of claim 1 wherein said saddle member is fastened to said sidewall by means of fasteners passing through apertures disposed through said sidewall, and a plurality of said apertures are disposed through said sidewall in a circular row to enable mounting said saddle to said sidewall in one of a plurality of positions providing for said drive shaft to project from said enclosure at an appropriate selected angle.

5. The improvement of claim 1 wherein said worm wheel has a shaft portion and a worm wheel portion integrally made of a single piece of metallic material, and a superficial coating on said metallic material of fluorocarbon material.

6. The improvement of claim 5 wherein said fluorocarbon material is polytetrafluoroethylene.

7. The improvement of claim 1 wherein said worm gear has a shaft portion and a worm gear portion integrally made of a single piece of metallic material, and a superficial coating on said metallic material of fluorocarbon material.

8. The improvement of claim 7 wherein said fluorocarbon material is polytetrafluoroethylene.

9. The improvement of claim 1 wherein another of said support members is a second identical open-ended enclosure comprising said pair of substantially parallel long sidewalls interconnected by said pair of substantially narrow sidewalls, said support bracket means for supporting said enclosure from the wall with said relatively long sidewalls substantially perpendicular to the axis of said shaft, said bearing means mounted on the end of said shaft and rotatably supported in a first aperture through one of said long sidewalls, said U-shaped saddle member having a second aperture providing a journal for a portion of said bearing means and said fastening means for attaching said U-shaped saddle to the inside surface of said long sidewall with said apertures substantially aligned.

10. The improvement of claim 9 wherein said second enclosure has a pair of aligned notches at each corner thereof and said support bracket means comprises a pair of flat plate members having a bifurcated end forming a leg engaged in said notches on one edge of said enclosure, one of said support bracket means being disposed above and the other below said second enclosure.

* * * * *